US011613835B2

(12) United States Patent
Shanley

(10) Patent No.: US 11,613,835 B2
(45) Date of Patent: Mar. 28, 2023

(54) HOOK FOR A TUFTING MACHINE

(71) Applicant: VANDEWIELE NV, Marke (BE)

(72) Inventor: Frank Shanley, Lancashire (GB)

(73) Assignee: VANDEWIELE NV, Marke (BE)

( * ) Notice: Subject to any disclaimer, the term of this patent is extended or adjusted under 35 U.S.C. 154(b) by 19 days.

(21) Appl. No.: 17/282,541

(22) PCT Filed: Oct. 4, 2019

(86) PCT No.: PCT/EP2019/076898
§ 371 (c)(1),
(2) Date: Apr. 2, 2021

(87) PCT Pub. No.: WO2020/070281
PCT Pub. Date: Apr. 9, 2020

(65) Prior Publication Data

US 2021/0372022 A1 Dec. 2, 2021

(30) Foreign Application Priority Data

Oct. 4, 2018 (GB) ..... 1816207

(51) Int. Cl.
*D05C 15/22* (2006.01)
*D05C 15/24* (2006.01)

(52) U.S. Cl.
CPC ..... *D05C 15/22* (2013.01); *D05C 15/24* (2013.01)

(58) Field of Classification Search
CPC ..... D05C 15/22; D05C 15/24; D05C 15/04
See application file for complete search history.

(56) References Cited

U.S. PATENT DOCUMENTS 2,982,240 A * 5/1961 McCutchen ..... D05C 15/36 112/80.52
3,019,748 A * 2/1962 Card ..... D05C 15/22 D15/66
3,595,184 A * 7/1971 Watkins ..... D05C 15/22 112/80.55
3,735,715 A * 5/1973 Passons ..... D05C 15/22 D8/15
4,048,930 A 9/1977 Card
(Continued)

FOREIGN PATENT DOCUMENTS

GB 931 360 A 7/1963
GB 931360 A * 7/1963
GB 1 314 649 A 4/1973

OTHER PUBLICATIONS

The International Search Report/Writen Opinion issued by the European Patent Office as International Search Authority dated Jan. 21, 2020; 8 pages.

*Primary Examiner* — Ismael Izaguirre
(74) *Attorney, Agent, or Firm* — Smith Gambrell & Russell LLP

(57) ABSTRACT

A hook (5) for a tufting machine to provide an enhanced J-cut effect. The hook comprises a shank portion (12) via which the hook is connected to the tufting machine, in use, and a working portion (4) extending from the shank portion. The working portion (4) comprises a cutting edge (6) on one side of a lower face of the working portion. A J-cut forming portion is formed at the working portion (4), in that the working portion in the region above the cutting edge has a greater thickness than the thickness of the shank portion (12).

15 Claims, 3 Drawing Sheets

(56) References Cited

U.S. PATENT DOCUMENTS

| | | | | |
|---|---|---|---|---|
| 4,557,209 | A | 12/1985 | Watkins | |
| 7,520,229 | B2 * | 4/2009 | Hillenbrand | D05C 15/24 112/80.5 |

* cited by examiner

HOOK FOR A TUFTING MACHINE

The present invention relates to a hook for a tufting machine.

In a tufting machine, a needle carrying a yarn reciprocates through a backing material in order to form a loop of yarn. The loop of yarn is caught on the hook to retain the loop as the needle is retracted.

The hook has a working portion which is the part that receives the loops of yarn and a shank portion via which the hook is connected to an underlying structure such as a bar or block via which it is connected to the tufting machine. The lower edge of the working portion is provided with a cutting edge which cooperates with a knife to cut the loops of yarn in order to form a cut pile carpet.

A typical hook used in a tufting machine is illustrated in FIG. 1A which is a cross section through one needle, the working portion of one hook and the knife.

The needle 1 is shown above backing material 2 having formed a loop of yarn 3 around the working portion 4 of a hook 5. The cutting edge 6 is provided in the lower left hand corner of working portion 4 and cooperates with a knife 7 which will cut the loop of yarn 3 formed on the hook 5. As is apparent from FIG. 1A, the working portion 4 is provided, on the side opposite to the side containing the cutting edge 6, with a chamfer 8. This is formed in order to reduce the phenomenon known as J-Cut. This is illustrated by the cut tuft 9 shown to the right of the hook 5 in FIG. 1A which represents the yarn after it has been cut. As can be seen here, there is a long yarn 10 on the right hand and a short yarn 11 on the left hand side. This is because, when the loop of yarn 3 is wrapped around the hook 5 as described above, the yarn on the right hand side with the hook has a longer path to the cutting edge 6. The presence of the chamfer 8 reduces the difference between the two paths. If it were not present, the yarn on the right hand side of the hook would have an even longer path to the cutting edge 6.

The J-Cut effect is further reduced by making the working portion 4 of the hook as thin as possible as, in general, the aim in a tufting machine is to form a carpet with a pile which is as uniform as possible.

As an exception to this general rule, some tufting machines have been designed to specifically exaggerate the J-Cut effect. This may be done, for example, for a tufting machine which can produce artificial grass. In order to provide a more realistic look, it is desirable to have an uneven pile size on artificial grass. As well as being desirable from a realistic point of view, this can produce increased technical performance as the feeling of the grass under foot and the interaction with a ball again mimics the effect of natural grass.

One example of such a machine is disclosed in U.S. Pat. No. 3,152,563. This discloses a hook having an insert which is inserted into the working portion of the hook on the opposite side to the cutting edge. The insert extends below the cutting edge thereby creating a longer path for the yarn which extends around the insert as compared to the path with extends to the cutting edge. Since the insert may not extend below the bill of the hook, to guarantee that the yarn loops will remain on the hook, however, its vertical dimensions are limited. Increasing the height of the hook, resulting in a lower bill in vertical direction and hence more space for the insert, is greatly limited by limitations imposed by the pick-up process of the yarn loops by the conventional tufting needles. Consequently to be able to produce more pronounced J-cuts the thickness of the hook is increased. As a result of this, the standard means of fastening a hook with slotted bars and screws or moulding it in a module block cannot be used. Further, the thicker shank means that less supporting material is available to secure the hook thereby leading to a weakened connection.

A second example is disclosed in GB931360. This is similar to U.S. Pat. No. 3,152,563 in that it discloses a downwardly extending insert which can create a longer path on the opposite side from the cutting edge to provide an enhanced J-Cut. In this case, however, the insert is pivotally mounted so that it can be moved vertically to a retracted position level with or above the cutting edge in which it does not create the enhanced J-Cut. The vertical dimensions of this insert are also limited. To provide a more pronounced J-cut the thickness of the hook is increased.

Moreover, the yarn tension defines the position of the insert. If the amount of yarn fed is below a certain threshold, the yarn tension is high enough to position the insert above the cutting edge and no J-cut is created. If the amount of yarn fed is above this threshold, the yarn tension will decrease, the insert will move a retracted position resulting in an enhanced J-cut. With this insert, the possibility of varying the pile height of the tufts is greatly reduced, as the pile feed also determines whether a J-cut is produced or not.

According to a first aspect the present invention, there is provided a hook according to claim 1.

The approach taken by the present invention is the opposite of a conventional tufting approach in that it deliberately provides a working portion which is thicker than the shank portion. This will exaggerate the J-Cut effect in that the length between the two yarns cut from a loop is increased because of the additional yarn path around the thicker working portion of hook. At the same time, the thinner shank portion allows a conventional hook mounting mechanism to be used. As far as we are aware, a hook for a tufting machine where the shank portion has a smaller thickness than the working portion is unique in a tufting machine.

A hook of this type is particularly designed for a tufting machine which can produce artificial grass.

The maximum thickness of the working portion in the region above the cutting edge is preferably at least 1.2 times, more preferably at least 1.5 times and most preferably at least 2 times greater than the thickness of the shank portion. On the other hand, the maximum thickness of the working portion in the region above the cutting edge is preferably less than 4 times the thickness of the shank portion.

In a cross section in a plane perpendicular to the cutting edge, the ratio of the maximum width of the hook to the maximum height is at least 0.3, preferably at least 0.4, more preferably at least 0.5 and most preferably at least 0.6. On the other hand, this ratio is preferably less than 1.2.

These ranges provide an appreciable thickness in the working portion of the hook which provides an enhanced J-Cut effect. On the other hand, the dimensions provide a hook which can readily be manufactured and accommodated within the existing tufting machine framework without requiring significant modifications.

Whilst it is possible for the working portion of a hook to be provided with a chamfer on the side of the hook opposite to the cutting edge, this is counterproductive in producing a J-Cut effect as it counteracts the increased thickness of the working portion. Therefore, preferably, the hook is devoid of a chamfer on the side of the hook opposite to the cutting edge.

Preferably the working portion of the hook tapers towards the tip of hook, resulting in a tip of conventional thickness and a smooth pick-up of the yarn loops on a tufting machine with conventional tufting needles.

The hook may be formed of a single piece of material. In this case, the material used is thicker than the material used for a conventional hook and the hook is cut to the desired dimensions.

Alternatively, the J-Cut portion may be formed by an insert extending from a main body of the hook to provide the greater thickness. Preferably the insert also forms the cutting edge of the hook. When incorporating an insert which also forms the cutting edge, the insert can be made of a harder material which increases the performance of the hook.

The insert is preferably rigidly attached to the main body of the hook. However, the insert may alternatively be movable with respect to the main body of the hook to vary the size of the J-Cut forming portion.

This forms a second aspect of the invention, according to which there is provided a hook according to claim 16.

Examples of hooks in accordance with the present invention will now be described with reference to the accompanying drawings in which.

Figure 2:
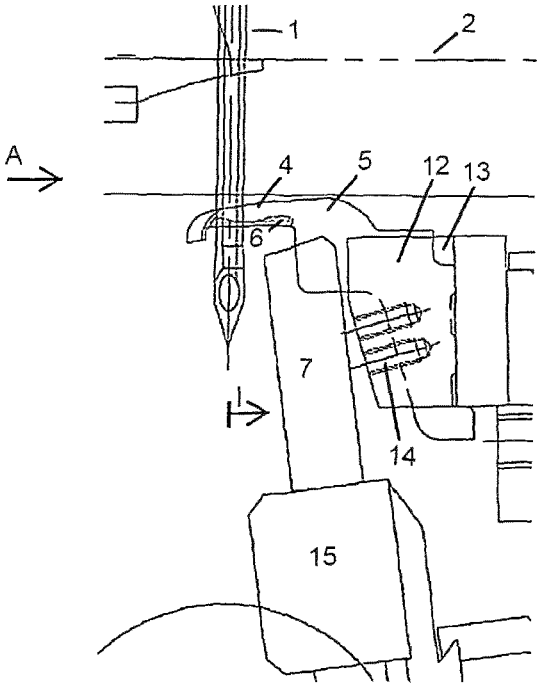
FIG. 2 is a side view of a needle, hook and knife showing the mounting for the hook and knife, this figure is equally applicable to the prior art and to the present invention.

Before describing the specifics of the present invention, the general operation of a hook in a tufting machine will be described with reference to FIG. 2.

A tufting machine is provided with a row of needles 1 extending across the width of the machine. Only one of these is shown in FIG. 2. The needles are arranged to reciprocate vertically to repeatedly penetrate a backing medium 2 to form loops of yarn (not shown in FIG. 2). As the needle 1 reaches bottom dead centre (as shown in FIG. 2) a hook 5 is rocked into the position shown in FIG. 2 in order to pick up the loop of yarn formed by the needle. Each hook 5 is associated with a knife 7 which is also reciprocally movable from a lower position shown in FIG. 2 to an upper position in which the knife cooperates with the cutting edge 6 on the hook in order to sever the loops of yarn on the hook in order to produce a cut pile carpet.

Each hook has a working portion 4 which is the part of the hook which includes the cutting edge 6 and a shank portion 12 via which the hook 5 is connected to the tufting machine. In this case, the shank portion 12 can have a conventional thickness and hence can be connected to a bar or block 13 via bolts 14 in a conventional fashion. Similarly, the knives 7 are mounted to a knife bar 15 such that a number of knives are reciprocated together.

Figures 1A, 1B, 1C:
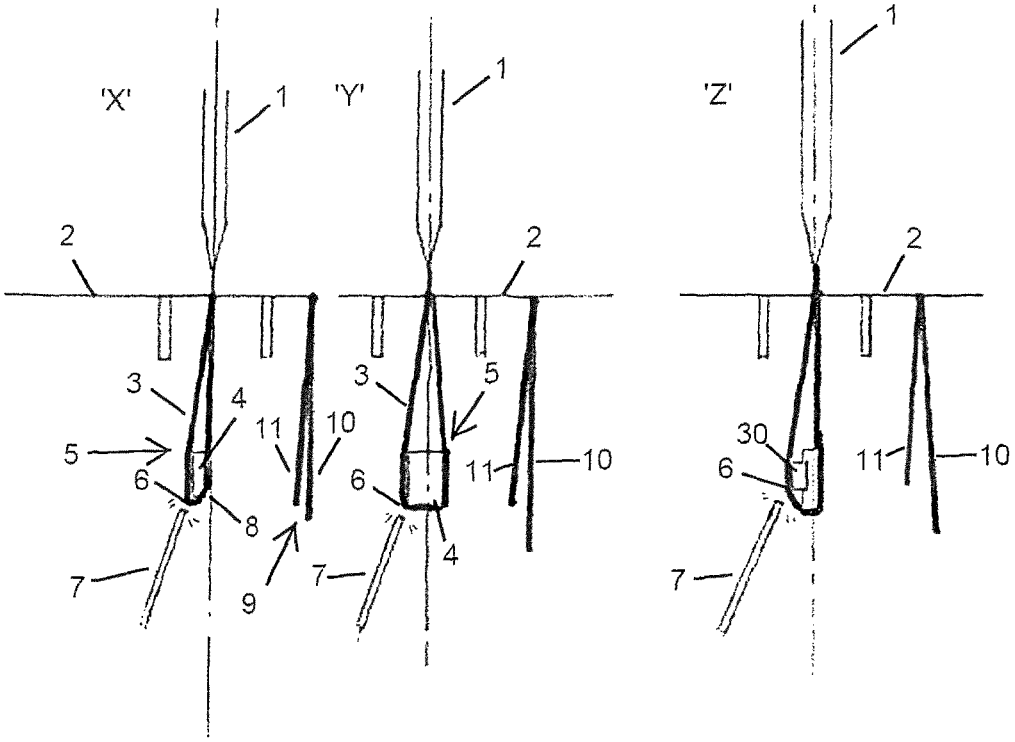
FIG. 1A is a schematic cross section through a needle, conventional hook and knife in a plane taken through line I-I in FIG. 2 (although the needle is shown in a raised position) showing a first loop of yarn on the hook and a second yarn after it has been cut and moved away from the hook.
FIG. 1B is a view similar to FIG. 1A of the first example of the present invention.
FIG. 1C is a view similar to FIG. 1A of a second example of the present invention.
Figure 3A:
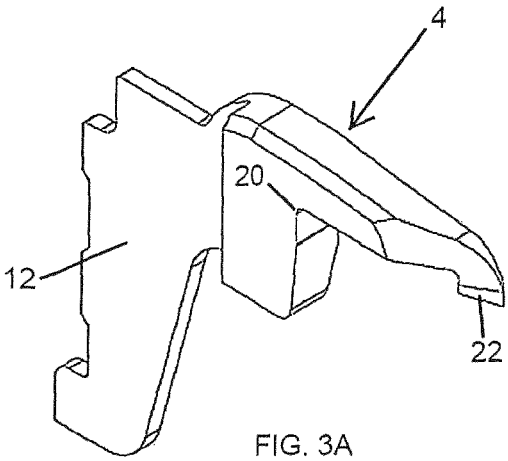
FIG. 3A is a perspective view of a first example of the present invention as shown in FIG. 1B from a first angle.
Figure 3B:
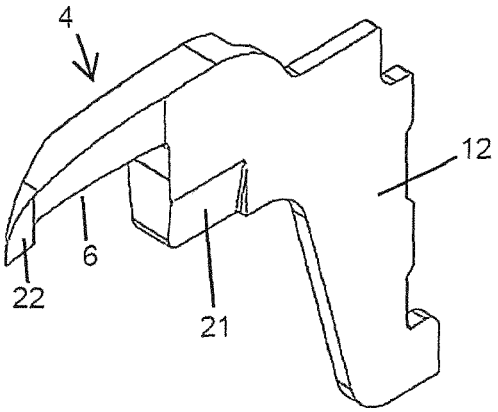
FIG. 3B is a perspective view of the first example from the opposite side to FIG. 3A.

The first example of the present invention is shown in FIG. 1B and FIGS. 3A and 3B.

In most senses, the hook is conventional. In particular, in the side view of FIG. 2, the hook is resembles a conventional hook. The difference resides in the fact that the working portion 4 is thicker than the shank portion 12. In particular, in the vicinity of a throat 20 and the cutting edge 6 the hook is significantly thicker than a conventional hook.

FIG. 3B shows the side of the hook which cooperates with the adjacent knife. This has a knife chamfer 21 which helps defining the optimum path for the knife 7 onto the cutting edge 6 of adjacent hook. However, as is apparent from FIGS. 3A and 3B there is no anti-J chamfer on the side opposite to the cutting edge 6. Instead, the thicker portion is maintained for the majority of the working portion 4. However, as is particularly apparent from FIGS. 3A and 3B, the hook then tapers back to a more conventional thickness towards the tip 22 of the hook. This is the part of the hook which first engages with a loop of yarn and is therefore as thin as possible in order to reliably penetrate the loop. This portion does not need to be as thick as the working portion 4 in the vicinity of the cutting edge 6 as this does not contribute to the J-Cut effect.

As is apparent from FIG. 1B, the yarn path for the loop of yarn 3 around the right hand side of the working portion 4 of the hook 5 is significantly longer than the path around the opposite side of the hook 5. When the loop of yarn is cut by the knife 7 at the cutting edge 6, this results in a cut pile yarn as depicted on the right hand side of FIG. 1B where the long yarn 10 is significantly longer (typically 4-5 mm) than the short yarn 11 as compared to the conventional arrangement depicted in FIG. 1A.

In order to create the hook with the thicker working portion, conventional techniques can be used in terms of cutting, treating and grinding the hook. The only difference will be that the starting material required to make the hook will be thicker.

The second example of the hook is shown in FIG. 1C and FIGS. 4A to 4C.

Figure 4B:
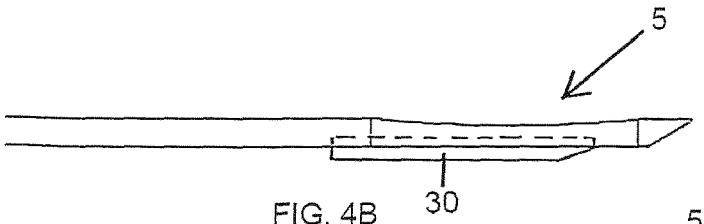
FIG. 4B is a top view of the second example of the hook.
Figure 4A:
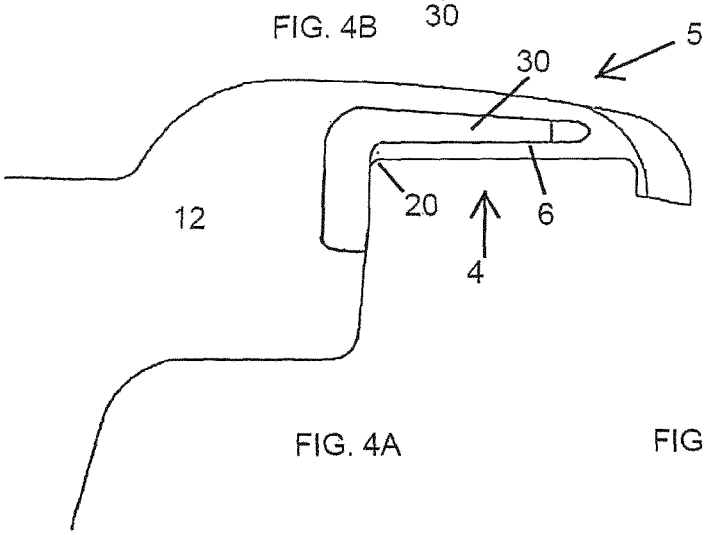
FIG. 4A is a side view of the second hook as shown in FIG. 1C.
Figure 4C:
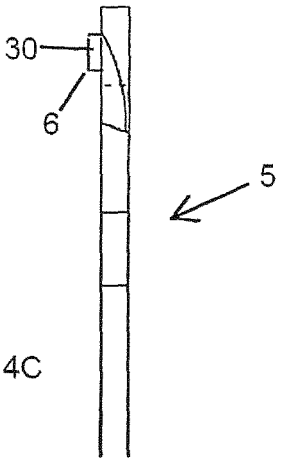
FIG. 4C is a front view of the second example.

In this case, rather than starting from an entire hook which is thicker and then removing the extra material in the shank area 12, the hook is made as a hook of a conventional or common thickness as best appreciated from FIG. 4C however, the increase in thickness of the working portion is provided by an insert 30 which extends around the throat 20 and into the shank portion 12 as shown in FIG. 4A. The insert is preferably made of a harder material than the main hook, such as tungsten carbide. As is apparent from FIG. 1C and FIG. 4C, the insert 30 provides the cutting edge 6 thereby improving the hook lifetime. The insert will be attached by means of spot welding, joining or bonding an additional profile piece.

As is apparent from FIG. 1C, the effect of the insert 30 is equivalent to the thicker hook of FIG. 1B in that it provides the increase differential between the yarn piles around the hook and hence a differential between the long yarn 10 and short yarn 11 which, in practice, is expected to be 4 to 5 mm.

Figure 5:
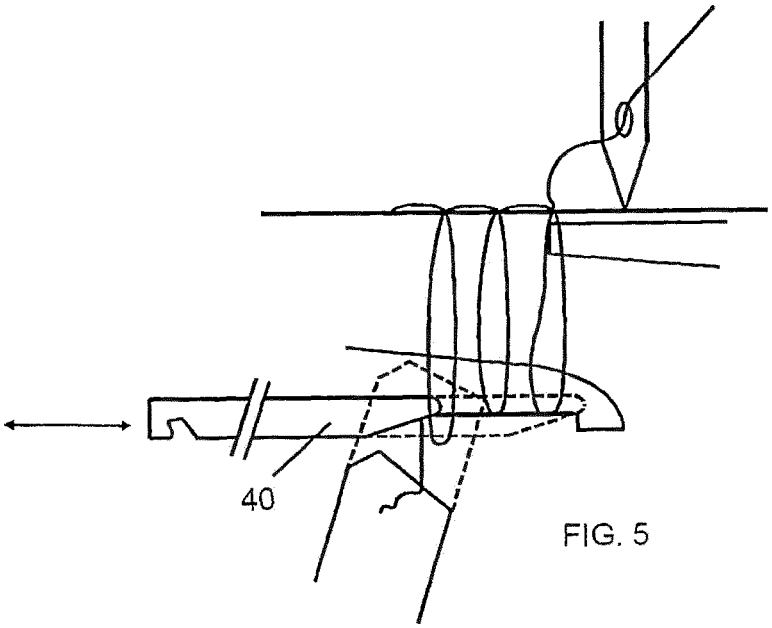
FIG. 5 is a side view of a hook, needle and backing using a third example of the hook.
Figure 5A:
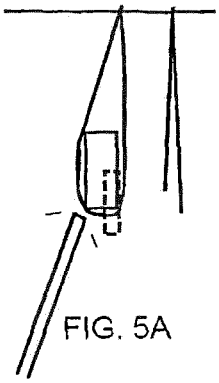
FIG. 5A is a view similar to FIGS. 1A-C of the third example in a second configuration.
Figure 5B:
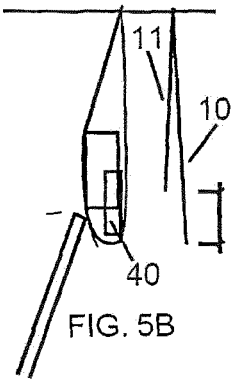
FIG. 5B is a view similar to FIG. 5A in a second configuration.

The third example is shown in FIGS. 5, 5A and 5B. This discloses a slidable insert 40 which can be reciprocated independent of the yarn feed using a type of reciprocating mechanism which is known in the context of a hook with a sliding gate (see, for example, GB2354263 and GB2367305).

As can be seen in FIG. 5, the insert 40 can be moved from a retracted position (shown in solid lines and in FIG. 5A) to a forward position (shown in dashed lines in FIG. 5 and in FIG. 5B). In the retracted position, the insert 40 does not interfere with the loop, such that the loop in FIG. 5A extends only around the hook and this operation is effectively the same as the operation depicted in FIG. 1B. However, when the insert 40 is extended into the forward position, the loop also extends around the insert 40 as shown in FIG. 5B thereby further increasing the differential between the yarn paths around the hook resulting in an even greater differential between the long 10 and short 11 yarns. In the situation of FIG. 5B this example also has a working portion which is significantly thicker than the shank portion. Also the tip of the hook has more or less the conventional thickness. The insert 40 in FIG. 5 is shown having a straight lower edge. It could, however, have an inclined lower edge to provide further variation in the length of the yarn path.

The invention claimed is:

1. A hook for a tufting machine, the hook comprising a shank portion via which the hook is connected to the tufting machine, in use, and a working portion extending from the shank portion and comprising a cutting edge on one side of a lower face of the working portion, wherein the hook is to provide an enhanced J-cut effect, wherein a J-cut forming portion is formed at the part of the working portion, that interacts, in use, with a knife in that the whole J-cut forming portion has a greater thickness, the from the cutting edge to the opposite face of the working portion, than the thickness of the shank portion.

2. The hook according to claim 1, wherein the thickness of the working portion in the region above the cutting edge is at least 1.2 times greater than the thickness of the shank portion.

3. The hook according to claim 2, wherein the thickness of the working portion in the region above the cutting edge is at least 1.5 times greater than the thickness of the shank portion.

4. The hook according to claim 3, wherein the thickness of the working portion in the region above the cutting edge is times greater than the thickness of the shank portion.

5. The hook according to claim 1, wherein the thickness of the working portion in the region above the cutting edge is less than 4 times the thickness of the shank portion.

6. The hook according to claim 1, wherein in a cross section in a plane perpendicular to and passing through the cutting edge, the ratio of the maximum width of the hook to the maximum height is at least 0.3.

7. The hook according to claim 6, wherein in the cross section in the plane perpendicular to and passing through the cutting edge, the ratio of the maximum width of the hook to the maximum height is at least 0.4.

8. The hook according to claim 6, wherein in the cross section in the plane perpendicular to and passing through the cutting edge, the ratio of the maximum width of the hook to the maximum height is at least 0.5.

9. The hook according to claim 6, wherein in the cross section in the plane perpendicular to and passing through the cutting edge, the ratio of the maximum width of the hook to the maximum height is at leak 0.6.

10. The hook according to claim 6, wherein in the cross section in the plane perpendicular to the cutting edge, the ratio of the maximum width of the hook to the maximum height is less than 1.2.

11. The hook according to claim 1, wherein the working portion of the hook is devoid of a chamfer on the side of the hook opposite to the cutting edge.

12. The hook according to claim 1 is formed from a single piece of material.

13. The hook according to claim 1, wherein the J-cut portion is formed by an insert extending from a main body of the hook to provide the greater thickness.

14. The hook according to claim 13, wherein the insert also forms the cutting edge of the hook.

15. The hook according to claim 13, wherein the insert is movable with respect to the main body of the hook to vary the size of the J-Cut forming portion.

* * * * *